US005497980A

United States Patent [19]

Chick

[11] Patent Number: 5,497,980

[45] Date of Patent: Mar. 12, 1996

[54] ASSEMBLY FOR USE IN PRECISION MACHINING

[76] Inventor: James P. Chick, Great Belt Rd., Butler, Pa. 16001

[21] Appl. No.: 62,273

[22] Filed: May 17, 1993

[51] Int. Cl.$^6$ ..... B25B 1/10

[52] U.S. Cl. ..... 269/43; 269/154; 269/155; 269/164; 269/282; 269/242

[58] Field of Search ..... 269/282, 283, 269/154, 155, 152, 242, 43, 906, 164

[56] References Cited

U.S. PATENT DOCUMENTS

| | | | |
|---|---|---|---|
| 4,529,183 | 7/1985 | Krason et al. | 269/43 |
| 4,736,934 | 4/1988 | Grech | 269/155 |
| 4,750,722 | 6/1988 | Chick | 269/155 |
| 4,969,637 | 11/1990 | Nishimura | 269/155 |
| 5,098,073 | 3/1992 | Lenz | 269/154 |
| 5,242,159 | 9/1993 | Bernstein | 269/154 |

*Primary Examiner*—Robert C. Watson
*Attorney, Agent, or Firm*—John W. Linkhauer

[57] ABSTRACT

The present invention provides precision machine vise equipment for use in the NC machining of workpieces which improves the efficiency of the operation by making it possible to insert, secure, and machine some plural number of workpieces, such as two, or more preferably, four, in each cycle of machine operation, while causing each of said workpieces to be precisely located with respect to each of three mutually perpendicular datum planes, and without the necessity of having the machinist or machine operator conduct a positioning or squaring operation. This is done by providing, in accordance with the present invention, in the first place, a two-place precision machine vise of the type described in U.S. Pat. No. 4,529,183, and in addition, an assembly, for use in place of the fixed central jaw thereof, which possesses the necessary attributes or features more particularly herein described and defined, namely, certain surfaces which are so located and oriented and provided with precise (ground-and-polished) finishes, plus the necessary means for manipulating the movable jaw members of the said assembly to enable it to operate selectively, as desired, to grasp or to release a workpiece in contact therewith.

6 Claims, 4 Drawing Sheets

ASSEMBLY FOR USE IN PRECISION MACHINING

BACKGROUND OF THE INVENTION

1. Field of the Invention

This invention relates to equipment for securing workpieces during a machining operation conducted with numerical-control equipment.

2. Description of the Prior Art

In the production of workpieces which have been subjected to some number of machining operations in order to produce, at (and precisely at) certain predetermined locations, certain predetermined desired machined features—holes of desired diameter and depth, slots, grooves, etc.—it is already well known to provide and use for such purposes some kind of so-called "numerical control" (NC) equipment, that is to say, equipment of a kind which includes not only the means for securing the workpiece and the drill or milling head or other tool for producing the desired features in the finished workpiece, but also a programmable computer means which will, in accordance with a program provided thereto, sequentially position and activate and de-activate the various tools that are to be brought into contact with the workpiece during a cycle of the operation thereof. When the task to be accomplished includes the making of some number of product workpieces which are intended to be as nearly identical and interchangeable as possible, which is often the case, the improvement in productivity which is obtainable with the use of such equipment, in contrast to the relative inefficiency of having the pieces made by a skilled machinist who repetitively performs the necessary manipulations, is immense. Given properly programmed NC equipment, a relatively unskilled machine operator can produce, in a remarkably short period of time, a number of machined workpieces which are reliably identical; the machinery operates—without error, hesitation, or interruption caused by fatigue or distraction—to subject each workpiece in its turn to the operation required.

The NC approach has proved to have its limitations, however, and there have already been developed some inventions which have been addressed to overcoming them.

It is known, for example, from U.S. Pat. No. 4,529,183, that in the case of the making of a plurality of workpieces which require more machining than can be done with one insertion of a workpiece into the NC equipment, there may be provided a "two-place" precision machine vise of the kind disclosed therein, a vise having a fixed central member which affords a fixed central reference point to each of two workpieces secured within the equipment. Such equipment is advantageously used, in accordance with the invention of the above-designated patent, by orienting the workpieces appropriately so that during one cycle of operation of the NC equipment, each workpiece undergoes the set of machining operations appropriate to its orientation, which thus makes it possible to produce a number of such product workpieces in a particularly advantageous and efficient manner by manipulating the equipment and the work fed to it in the manner described in the paragraph bridging columns 4 and 5 of said patent, thereby producing one finished workpiece for each cycle of operation of the equipment.

The device of the patent discussed above serves to locate a workpiece accurately with respect to only two datum planes, namely, the one afforded by the side of the fixed central jaw member and the one defined by the bed of the two-place precision machine vise. It is desirable to be able to position a workpiece accurately and quickly, without squaring or the use of an edge locator, with respect to yet a third datum plane, one which is mutually perpendicular to the other two and thus defines the location of the workpiece in a direction crosswise of the longitudinal axis of the two-place precision machine vise. In this regard, it has by now also become known, in accordance with U.S. Pat. No. 4,750,722, to address that problem by providing a supplemental precision machine vise, a smaller one, which may be mounted to the fixed central jaw of the main precision machine vise in place of the jaw plate thereof, or otherwise attached thereto.

SUMMARY OF THE INVENTION

There has not been, prior to the present invention, precision machine vise equipment for use in the NC machining of workpieces which serves the purpose of improving the efficiency of the operation by making it possible to insert, secure, and machine some plural number of workpieces, such as two, or more preferably, four, in each cycle of machine operation, while causing each of said workpieces to be precisely located with respect to each of three mutually perpendicular datum planes and without the necessity of having the machinist or machine operator conduct a positioning or squaring operation. The above-indicated need is met by providing, in accordance with the present invention, in the first place, a two-place precision machine vise of the kind described in U.S. Pat. No. 4,529,183, and in addition, an assembly, for use in place of the fixed central jaw thereof, which possesses the necessary attributes or features more particularly herein described and defined, namely, certain surfaces which are so located and oriented and so provided with precise (ground-and-polished) finishes, plus the necessary means for manipulating the movable-jaw members of the said assembly to enable it to operate selectively, as desired, to grasp or to release a workpiece in contact therewith. The present invention brings to task of machining a plurality of workplaces which need to be located accurately with respect to three mutually perpendicular datum planes an increase in productivity on the order of that which was achieved with the introduction of the two-place precision machine vise of the kind shown in U.S. Pat. No. 4,529,163.

DESCRIPTION OF THE DRAWINGS

A complete understanding of the invention may be obtained from the foregoing and the following description thereof, taken in conjunction with the appended drawings, in which.

DESCRIPTION OF THE PREFERRED EMBODIMENTS

Figure 1:
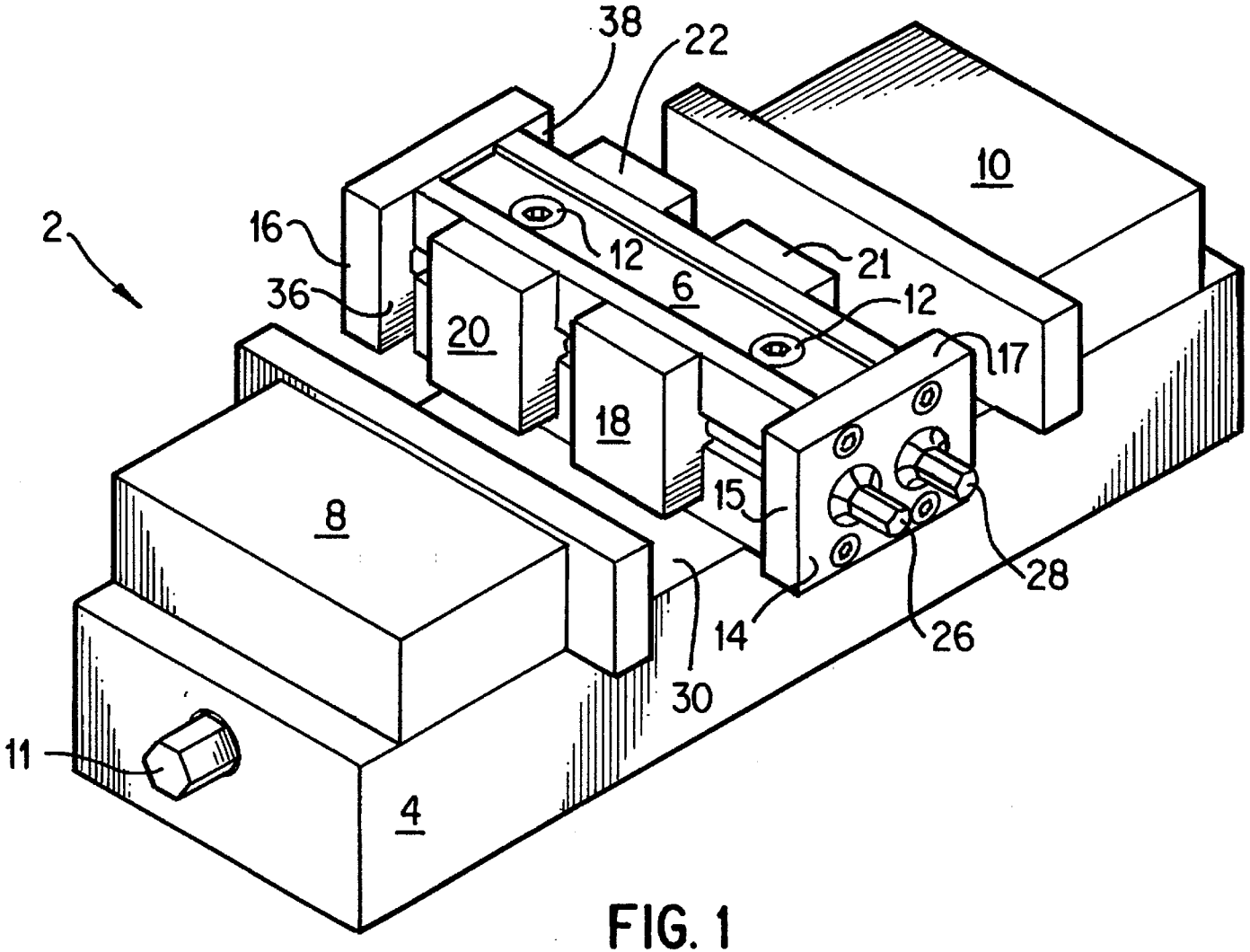
FIG. 1 is an isometric view of a two-place precision machine vise, such as one according to U.S. Pat. No. 4,529,183, which has been provided with an assembly in accordance with a first and preferred embodiment of the present invention.

FIG. 1 shows a two-place precision machine vise, indicated generally at 2, which is to be understood as being one in accordance with U.S. Pat. No. 4,529,183, having a base 4, a central member 6 affixed thereto, and a pair of movable jaw members 8 and 10 which are, as more fully described in that patent, operatively connected with a rotatable shaft member 11 which can be activated to cause first one and then the other of the members 8 and 10 to approach the fixed central member 6 in order to hold workpieces (not shown) thereagainst.

Figure 2:
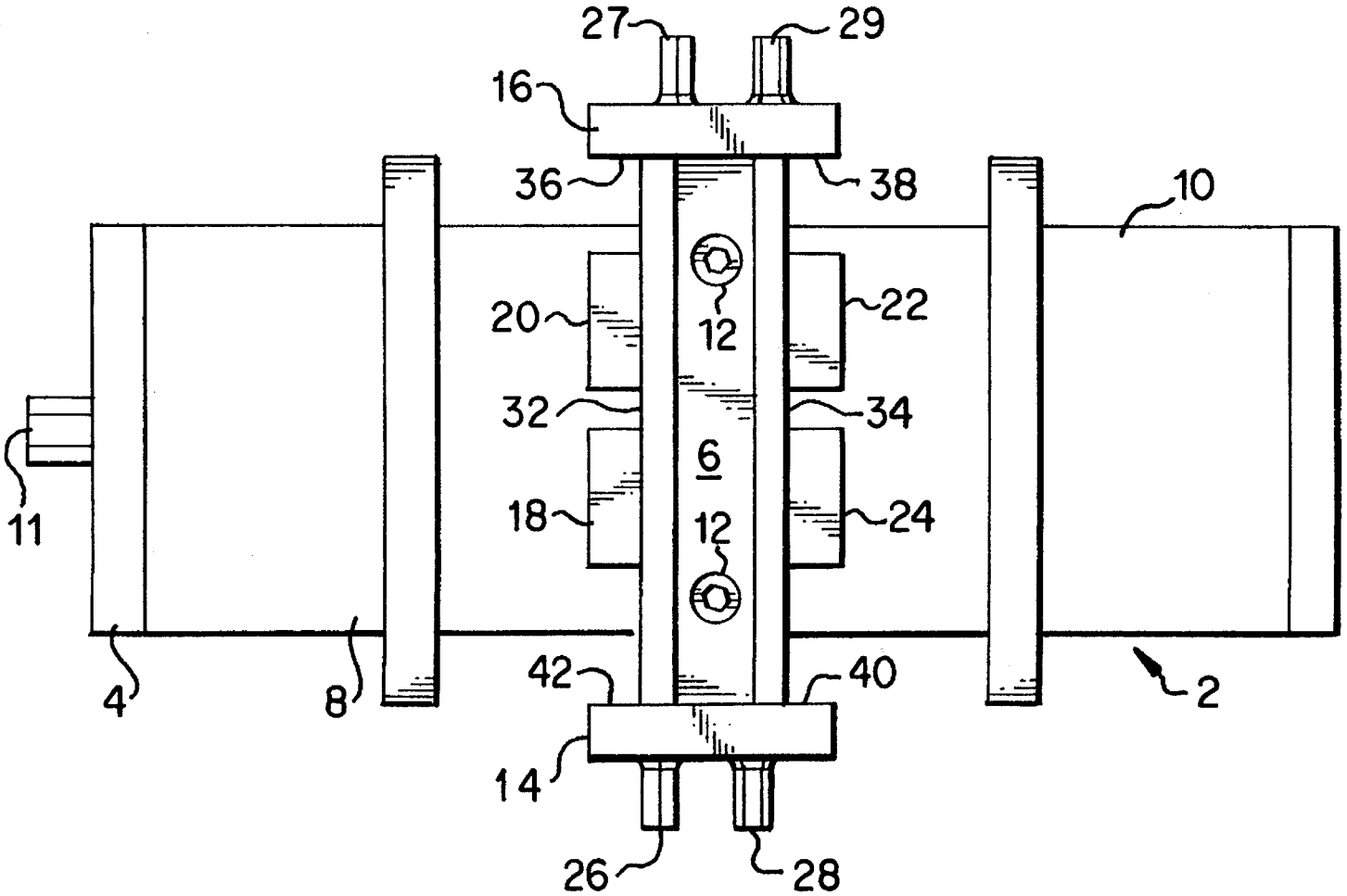
FIG. 2 is a plan view of a machine vise and assembly indicated in FIG. 1.

Moreover, in accordance with the somewhat elaborate preferred embodiment of the invention depicted in FIG. 1, the fixed central member 6 is one which is adapted to hold four workpieces, two on each side thereof, and accordingly, it has, in addition to the bolts 12 by means of which it is secured to the base 4, two end portions 14 and 16, each of which is fixedly connected to the body portion of the fixed central member 6 and each of which also possesses ear portions 15 and 17 projecting outwardly therefrom in a direction parallel to the longitudinal axis of the precision machine vise, one ear portion 15 projecting in the direction of the first movable jaw 8 and the other ear portion 17 projecting in the direction of the other movable jaw 10. In accordance with this embodiment of the invention, the assembly includes four slide members 18, 20, 22, and 24, and these are each adapted to be moved transversely with respect to the longitudinal axis of the two-place precision machine vise by means of a shaft, such as the shaft 26 or the shaft 28, which is journaled in an adjacent end portion of the fixed central member 6. To be more specific, the slide member 18 is operated by means of the shaft 26, and the slide member 24 is operated by means of the shaft 28, and there are also two additional shaft members 27 and 29 (these are not seen in FIG. 1 but are indicated in FIG. 2) which are journaled in the end portion 16 and serve to operate, respectively, the slide members 20 and 22.

Moreover, in accordance with the objective that this assembly will operate in such a manner as to make it possible to position four workpieces with each of them being located precisely with respect to three mutually perpendicular datum planes, it is important that an assembly which is in accordance with the invention have certain surfaces which are planar and are provided with an appropriate finish, which means in most cases a ground and polished finish or its equivalent. Thus, for example, in the case of the assembly depicted in FIG. 1, one such flat-finished surface is the horizontally extending surface 30 which is the bed of the two-place precision machine vise 2, and another is the surface 32, a vertically extending surface running transversely with respect to the longitudinal axis of the precision machine vise 2, being the one side surface of the fixed central member 6. Another one still of such fiat-finished surfaces is the corresponding other side surface 34 (see FIG. 2) of the fixed central member 6. In accordance with the invention, there is provided yet another family of similarly flat-finished planar surfaces, namely, the ones that extend vertically but parallel to the longitudinal axis of the two-place precision machine vise 2, these being the surfaces at 36, 38, 40, and 42.

Figure 3:
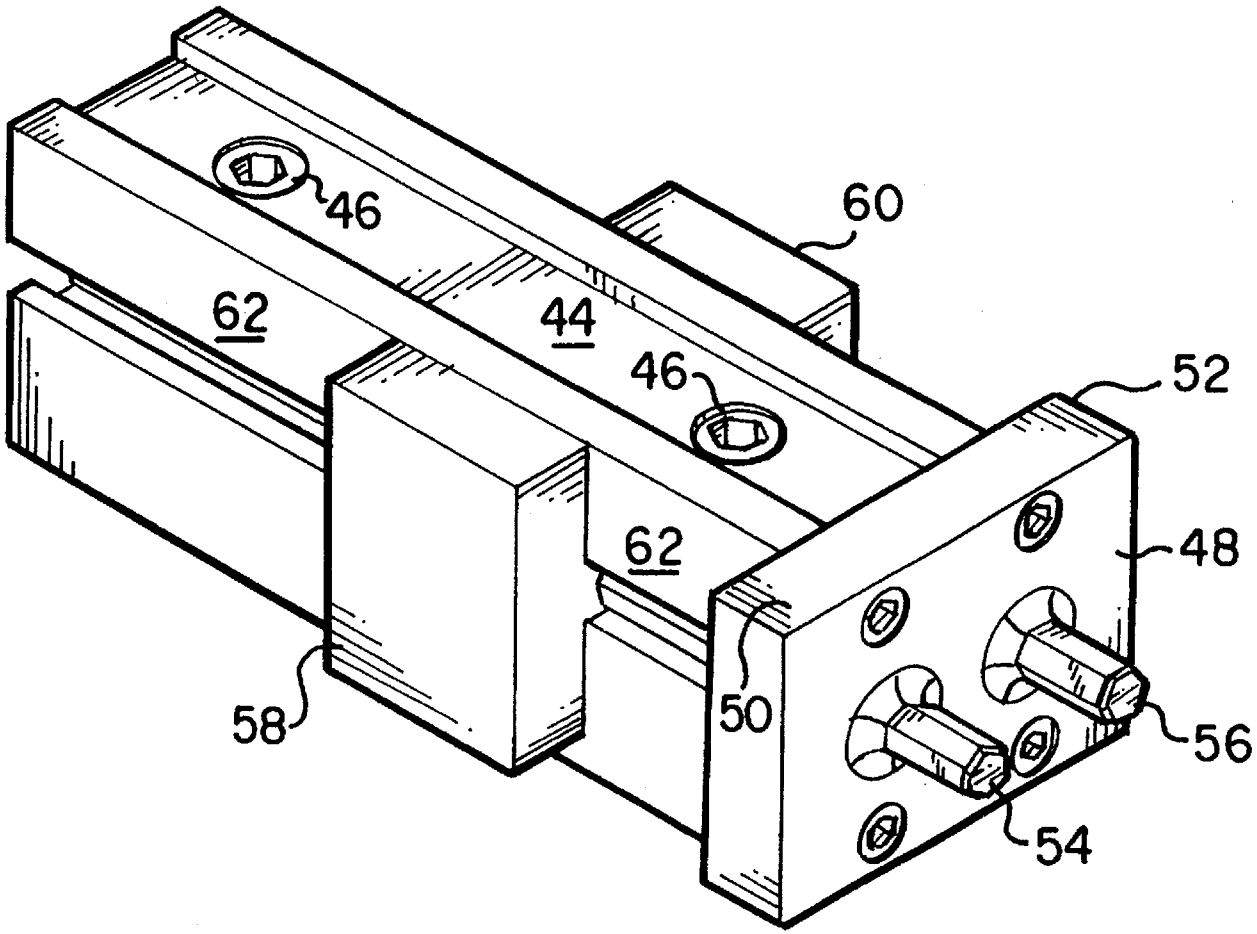
FIG. 3 is an isometric view of a second embodiment of an assembly in accordance with the present invention.

Another embodiment of the invention is shown in FIG. 3. In this embodiment of the invention, the assembly operates to position only two, instead of four, workpieces precisely with respect to three mutually perpendicular datum planes, with the workpieces being located on opposite sides of the fixed central member 44, which is to be understood as corresponding to the fixed central member 6 discussed above.

As before, bolt means 46 serve to affix the central member 44 to the base of the precision machine vise 2 (not shown in FIG. 3), and the central member 44 has securely affixed thereto at one end thereof a side portion 48 having ear portions 50 and 52, wherein there are journaled shaft members 54 and 56 for positioning the slide members 58 and 60, respectively. Those skilled in the art will know which surfaces of the above structure are to be provided with planar surfaces and appropriate finishes in order to assure the desired effect of having the workpieces precisely positioned with respect to the aforementioned datum planes, these corresponding to the bed of the precision machine vise 2, the side 62 of the member 44, and vertical interior surfaces of the ear portions 50 and 52.

Figure 4:
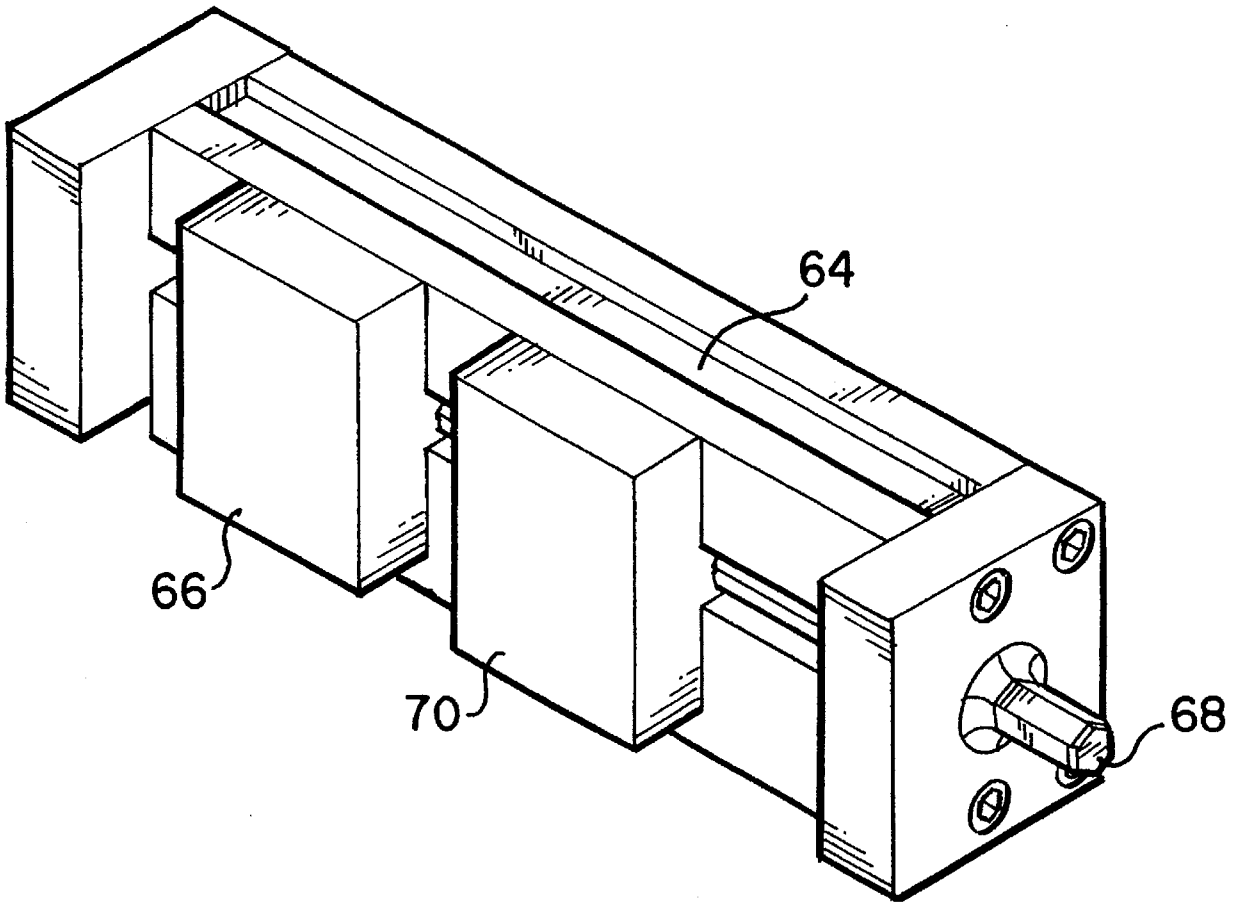
FIG. 4 is an isometric view of a third embodiment of an assembly in accordance with the present invention.

Still another embodiment of the invention is shown in FIG. 4. In this embodiment of the invention, the assembly also operates to position only two, instead of four, workpieces precisely with respect to three mutually perpendicular datum planes, with the workpieces being in this case located on the same side of the fixed central member 64, which is to be understood as corresponding to the fixed central member 6 discussed above. For simplicity, the bolt means are not shown, and it is to be understood that there is also another shaft means (not shown or numbered) which operates to position the slide member 66 the same as the shaft member 68 operates to position the slide member 70. Either that, or the shaft member 68 is provided with right- and left-hand screw means and operative connection with both slide members 66 and 70.

While I have shown and described herein certain embodiments of my invention, I intend to cover as well any change or modification therein which may be made without departing from its spirit and scope.

I claim as my invention:

1. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a ground and polished planar working face adapted to serve as the bed of an auxiliary vise means, at least two movable-jaw members, each of which has a ground and polished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a ground and polished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar ground-and-polished faces facing said end portion which are oriented parallel to said surface of said end portion facing said movable-jaw member, wherein the assembly comprises two slide members which are on the same side of said body portion and are changed in position by separate shaft means journaled in separate end portions at opposite ends of said body portion.

2. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a ground and polished planar working face adapted to serve as the bed of an auxiliary vise means, at least two movable-jaw members, each of which has a ground and polished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a ground and polished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar ground-and-polished faces facing said end portion which are oriented parallel to said surface of said end portion facing said movable-jaw member, wherein the assembly comprises two slide members which are on opposite sides of said body portion and are changed in position by shaft means comprising separate shafts which are journaled in projecting portions of a single end portion which is located at one end of said body portion.

3. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a ground and polished planar working face adapted to serve as the bed of an auxiliary vise means, at least two movable-jaw members, each of which has a ground and polished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a ground and polished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar ground-and-polished faces facing said end portion which are oriented parallel to said surface of said end portion facing said movable-jaw member, wherein the assembly comprises four slide members, two on a first side and two upon a second and opposite side of said body portion, and each of said four slide members is provided with a separate shaft means journaled within an adjacent end portion whereby its position may be controlled.

4. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a suitably flat-finished planar working face adapted to serve as the bed of an auxiliary vise means, at least two movable-jaw members, each of which has a suitably flat-finished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a suitably flat-finished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar suitably flat-finished faces facing said end portion which are oriented parallel to said surface of said end portion facing said movable-jaw member, wherein the assembly comprises two slide members which are on the same side of said body portion and are changed in position by separate shaft means journaled in separate end portions at opposite ends of said body portion.

5. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a suitably flat-finished planar working face adapted to serve as the bed of an auxiliary vise means, at least two movable-jaw members, each of which has a suitably flat-finished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a suitably flat-finished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar suitably flat-finished faces facing said end portion which are oriented parallel to said surface of said end portion facing said movable-jaw member, wherein the assembly comprises two slide members which are on opposite sides of said body portion and are changed in position by shaft means comprising separate shafts which are journaled in projecting portions of a single end portion which is located at one end of said body portion.

6. An assembly for use as the fixed central two-sided jaw member of a precision machine vise, said assembly comprising a body portion adapted to be positioned transversely of said precision machine vise and containing means for securely attaching said assembly thereto, said body portion possessing at least one side surface adapted to be oriented perpendicularly with respect to the bed surface of said precision machine vise and at the same time also perpendicularly with respect to the longitudinal axis of said precision machine vise, said side surface being provided with a suitably flat-finished planar working face adapted to serve as the bed of an auxiliary vise means, at least two movable-jaw members, each of which has a suitably flat-finished planar face adapted to be moved transversely with respect to said longitudinal axis of said precision machine vise while in contact with a side surface of said body portion which is oriented perpendicularly with respect to the bed surface of said precision machine vise and at the same time also perpendicularly with respect to the longitudinal axis of said precision machine vise, at least one end portion fixedly connected to said body portion and projecting outwardly therefrom in a direction parallel to the longitudinal axis of said precision machine vise, said end portion having a surface facing said movable-jaw members which is planar and provided with a suitably flat-finished surface and oriented perpendicularly with respect to both a planar bed surface of said precision machine vise and said side surface of said body portion, and shaft means journaled for rotation in said end portion and operatively connected to said movable-jaw members for moving same towards or away from said end portion, said movable-jaw members each having planar suitably flat-finished faces facing said end portion which are oriented parallel to said surface of said end portion facing said movable-jaw member, wherein the assembly comprises four slide members, two on a first side and two upon a second and opposite side of said body portion, and each of said four slide members is provided with a separate shaft means journaled within an adjacent end portion whereby its position may be controlled.

* * * * *